US007819343B2

(12) United States Patent
Paul et al.

(10) Patent No.: US 7,819,343 B2
(45) Date of Patent: Oct. 26, 2010

(54) DECOKING TOOL

(75) Inventors: Wolfgang Paul, Bad Schwartau (DE); Dirk Heidemann, Schwerte (DE); Kay Simon, Iserlohn (DE); Thomas Graefenstein, Dortmund (DE); Steffen Krenzer, Bochum (DE)

(73) Assignee: Ruhrpumpen GmbH, Witten (DE)

( * ) Notice: Subject to any disclaimer, the term of this patent is extended or adjusted under 35 U.S.C. 154(b) by 356 days.

(21) Appl. No.: 11/967,316

(22) Filed: Dec. 31, 2007

(65) Prior Publication Data

US 2009/0165618 A1 Jul. 2, 2009

(51) Int. Cl.
*A62C 31/00* (2006.01)

(52) U.S. Cl. ..... 239/446; 239/443; 239/550; 239/581.1; 239/DIG. 13; 299/17; 299/81.2

(58) Field of Classification Search ..... 239/436, 239/443, 446, 447, 449, 548, 550, 569, 581.1, 239/DIG. 13; 299/17, 81.2; 175/339, 393
See application file for complete search history.

(56) References Cited

U.S. PATENT DOCUMENTS

| | | | | | |
|---|---|---|---|---|---|
| 4,275,842 | A * | 6/1981 | Purton et al. | ..... | 239/446 |
| 4,738,399 | A * | 4/1988 | Adams | ..... | 239/447 |
| 4,923,021 | A * | 5/1990 | Courmier et al. | ..... | 239/DIG. 13 |
| 5,816,505 | A * | 10/1998 | Tran et al. | ..... | 239/443 |
| 6,644,567 | B1 * | 11/2003 | Adams et al. | ..... | 239/447 |

FOREIGN PATENT DOCUMENTS

| | | |
|---|---|---|
| DE | 10392866 | 6/2005 |
| WO | 2005105953 | 11/2005 |

* cited by examiner

*Primary Examiner*—Steven J Ganey
(74) *Attorney, Agent, or Firm*—Luedeka, Neely & Graham, P.C.

(57) ABSTRACT

In a tool for cutting up coke, comprising a housing mounted on a drill stem in the operating condition, and wherein at least one cutting nozzle for cutting and one boring nozzle for boring coke by means of a water jet, and a switchable valve means arranged in a flow-through channel for alternatively feeding the water to the flow channels in a flow body for the paths to the cutting and boring nozzles, and a switching apparatus manually or water-pressure-controlled operable at switching pressure of the water within the flow-through channel, for switching the valve means, are arranged, comprising a distribution apparatus rotatably supported above the flow body, with at least one valve body for closing off at least one opening of the flow channels, wherein depending on each angular position of the distribution apparatus with respect to the flow body, the flow path of the water to the boring nozzle or the flow path to the cutting nozzle is free or obstructed, for easier rotation of the distribution apparatus, it is provided that the valve body has means for compensating the pressure within the flow channel below the valve body to switching pressure as in the flow-through channel.

9 Claims, 5 Drawing Sheets

DECOKING TOOL

The present invention refers to a tool for cutting up coke comprising a housing according to the preamble of claim 1.

In oil refineries, the last, unusable fraction of crude oil is converted into coke. The conversion is carried out by conducting this fraction into upright drums having considerable capacity and having a height of about 40 m, for example, and having a diameter of, for example, 8 m. The drums are filled with coke over the operating duration. Once the maximum capacity of a drum is reached, the coke is cut out from the drum. This process referred to as "decoking" is carried out with high-pressure water jets which break up the coke in the drum and flush it out of the drum. A tool for generating the high-pressure water jets is mounted on a drill stem supplied with water under high pressure, and is introduced together with the drill stem into the drum from above. First, the tool is used to bore a continuous coaxial hole from the top to the bottom, wherein the high-pressure water jets exit from boring nozzles usually arranged at the lower end of the tool for breaking up the coke. Then the tool is switched from the boring function to the cutting function by obstructing the flow path of the pressurized water to the boring nozzles and freeing instead flow paths to cutting nozzles circumferentially arranged on the tool and from which the high-pressure water jets exit in a direction essentially transverse to the longitudinal axis of the tool and the drill stem, and break up the coke across the cross section of the drum in a spiraling path. This is because the tool with the drill stem executes a rotary motion during boring and during cutting of the coke. The coke broken up in this manner is flushed out from the bottom of the drum.

A tool known from WO 2005/105953 A1 of the initially mentioned type, in a housing provided with boring and cutting nozzles, comprises an essentially cylindrical flow body having four flow channels extending though it, the top openings of which are closable in pairs by two preferably loose calotte-shaped or disk-shaped valve bodies of a valve means as a distributing means. The valve means is arranged in the supply channel having water supplied to it under high pressure from the drill stem when the tool is in operation, the tool being mounted on the drill stem by a flange enclosing the supply channel. When the tool is operated, water under a high operating pressure flows into the tool and, depending on each switching position of a control apparatus linking a switching apparatus with the valve means, is directed either through the flow channels to the boring nozzles or to the cutting nozzles and used there for boring or cutting the coke material.

For switching the tool from "boring" to "cutting" and vice versa, the valve means comprises cages or guide means for the valve bodies. Using these, the two diametrically opposed valve bodies can be optionally displaced onto a pair of openings in the flow body for obstructing the boring function or to a different pair of openings for obstructing there the cutting function. When the pair of openings for the boring function is closed by the valve bodies, the opening pair for the flow paths of the water for cutting is free and vice versa.

To switch from the boring function to the cutting function, the operating pressure is lowered as far as possible—to the so-called switching pressure. The control apparatus is turned 90° each time by a manually externally operable drive as the driving apparatus. The control apparatus can also be operated by a water-pressure-controlled switching apparatus.

The use of a pair of calotte-shaped or disk-shaped valve bodies for closing off the openings of the flow channels having their nozzles deactivated for the current function of the tool, when switching the tool, is very advantageous for the residual or switching pressure, unlike large surface areas of valve plates of tools described further below. This is because the forces acting on the preferably loose valve bodies via the switching pressure, which counteract displacement of the valve bodies by means of the guiding means, are comparatively small.

However, the tool could be further improved by further reducing the switching forces in order to further facilitate switching of the tool from the boring function to the cutting function and vice-versa. The same applies in particular for tools of this type having valve means, in which the distribution apparatus comprises a valve disk corresponding to the flow-through cross section of the flow-through channel as a valve body, which is rotatably arranged above the flow body. Such a tool is disclosed, for example, in U.S. Pat. No. 5,816,505.

Based on a tool of the initially mentioned type, for lowering the switching forces during switching of the tool from the boring function to the cutting function and vice versa, it is suggested according to the present invention, that the valve body has means for compensating the pressure within the flow channel below the valve body to switching pressure as in the flow-through channel.

According to the present invention, therefore, the means, which the valve body comprises, allow for the pressure within the flow channel below the valve body to be brought to the switching pressure present in the flow-through channel, as soon as the operating pressure is reduced from the operating pressure to the switching pressure for switching of the tool. This means that, according to the present invention, the switching pressure is now present above and below the valve body. Since approximately ambient pressure is present within the flow channel closed off by the valve body due to the nozzle openings, this pressure compensation usually means raising the pressure below the valve body to the switching pressure of about 5 bar, for example.

Hitherto, valve bodies guided by cages have been pressed out of their seats at a switching pressure reduced as far as possible to within the order of magnitude of about 5 bar before they could be moved to their new positions with their cages or their guiding apparatus. The forces to be exerted with switching for releasing and lifting the valve bodies from their seats result in a correspondingly strong dimensioning of all components involved in the further movement of the valve body. A compensation of the pressure according to the present invention below the valve body to the switching pressure as in the flow-through channel allows for a considerable reduction of the mechanical stress on the switching components, which is why the dimensions may also be reduced. The reduced stresses due to the pressure compensation on the valve body increases operational security and reliability of the overall switching apparatus by reducing the switching forces.

Further advantages are caused by the application of the inventive principle on a tool, wherein a valve disk is provided which is supported above the flow body having sections for closing and openings for exposing openings of the flow channels for dividing the water entering through the flow-through channel. According to the inventive principle, the valve disk comprises means for automatic compensation of the pressure below the valve disk to the switching pressure in the flow-through channel in the present tool in the sections for closing openings of the flow channels. The advantages are of particular effect because, according to the present invention, the extremely strong force with which the valve disk is pressed onto the flow body due to its large surface exposed to the switching pressure, is now eliminated by the pressure compensation. All other advantages of the inventive principle mentioned above apply to the present tool, because the above-mentioned calotte-shaped valve bodies correspond to the sections of the valve disk for closing openings of the flow channels in their function and effect.

The means for compensating the pressure below the valve body to the switching pressure in the flow-through channel preferably provides (according to claim 2) that the valve body has a closure body and a communication between the underside of the closure body facing the flow channel and the operating-pressure side of the closure body exposed to the operating pressure of the water in operation for pressure compensation, and means for opening the communication for pressure compensation as soon as the operating pressure is reduced to switching pressure. The communication establishes the pressure compensation and extends from the underside of the closure body to an operating-pressure side of the closure body, which can be situated on its circumference or on its top side, as long as it is exposed to the operating pressure. The function of the communication for pressure compensation is controlled by means which respond when the operating pressure is reduced to switching pressure. These effects occur both with valve bodies guided by cages and with valve bodies comprising a single rotatable valve disk and having their closure bodies formed by sections for closing off openings of the flow channels.

Preferably the communication for pressure compensation comprises at least one channel (claim 3), having an opening which is open at the underside of the closure body and having another opening at the operating-pressure side of the closure body, which is associated with a closure which closes the other opening at operating pressure and opens it at switching pressure for pressure compensation. The channel always has an opening at the underside of the closure body, where ambient pressure is present due to the connected flow channel and its nozzle. The other opening on the operating-pressure side of the closure body is on the top side of the closure body. With valve bodies guided by cages, it can also be on the circumference of the closure body.

Suitably the closure for the other opening of the channel or the channels comprises a spring-biased cap (claim 4). The spring is dimensioned such that the cap is opened when the operating pressure is reduced to switching pressure.

The closure preferably comprises two annular sealing surfaces, one on the underside of the cap and the other on the top side of the closure body, which work together to open and close the closure (claim 5).

Preferably the channel also extends between the underside and the top side of the closure body, also with valve bodies guided by cages (claim 6), which has mainly structural advantages. According to a further development of the present invention, it is provided that the previously mentioned closure has a top recess at the top side of the closure body below the cap, with which the channel is in communication via its other opening (claim 7). This results in a common closure for all channels which are arranged in the closure body for pressure compensation.

Preferably, a piston displaceable under spring pressure within a blind hole bore in a sealed manner carries the cap in such association with the other opening of the channel that the cap is guided by the piston movement when it closes or opens the other opening of the channel (claim 8). The result is a simple structure for the self-balancing function of the valve body in the present embodiment. This is because a sufficiently dimensioned blind hole bore can be formed within the closure body as a cylinder for the piston and for arranging the spring between the bottom of the bore and the piston. At least one channel can extend from the underside to the top side of the closure body immediately adjacent to the bore. The other opening of the channel can be closed off either by a sealing surface associated with the opening or preferably by a closure consisting of mutually associated sealing surfaces on the top side of the closure body and the underside of the cap.

In an alternative embodiment of the valve body it is preferably provided that a shank displaceable under pressure of a spring within a guide bore of the closure body carries the cap in such association with the closure that the closure is closed at operating pressure and opened at switching pressure (claim 9). While in this simplified embodiment, the stroke movement of the cap of the valve body is still caused by the extension of a spring, however the cap has a shank on its underside for guiding, which is guided in a guiding bore of the closure body with play and its stroke movement is limited in a simple manner.

Both aforementioned embodiments of the valve body can also be provided as sections of a relatively large-surface valve disk rotatably supported on the flow body. These sections correspond to the two diametrically opposed areas of the valve disk, which alternately close the two flow channels to the boring nozzles or the two flow channels to the cutting nozzles by a 90° rotation of the valve disk, while two openings in the valve disk, each offset to the areas by 90°, also diametrically opposed to each other, expose the entry of the pressurized water to the flow channels. As shown with an exemplary embodiment described and illustrated in the following, also the above mentioned sections of the valve plate can be easily formed for automatic pressure compensation according to the present invention (claim 9).

Exemplary embodiments of the invention will be described in more detail in the following with reference to the accompanying drawings, in which.

Figure 1:
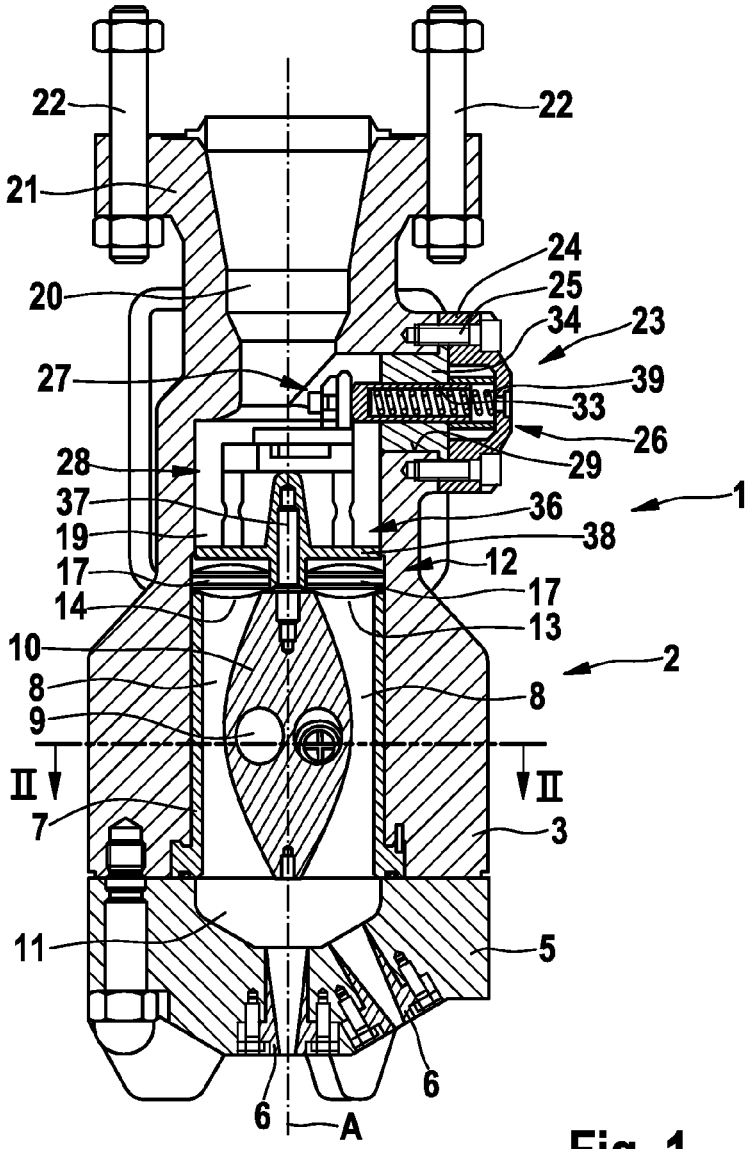
FIG. 1 is a longitudinal sectional view of a first embodiment of a tool according to the present invention for cutting up coke.
Figure 2:
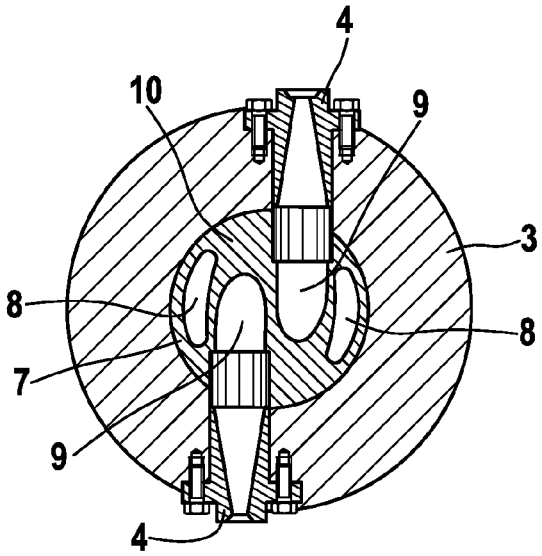
FIG. 2 is a cross sectional view along line II-II of FIG. 1 of the tool according to FIG. 1.
Figure 2A:
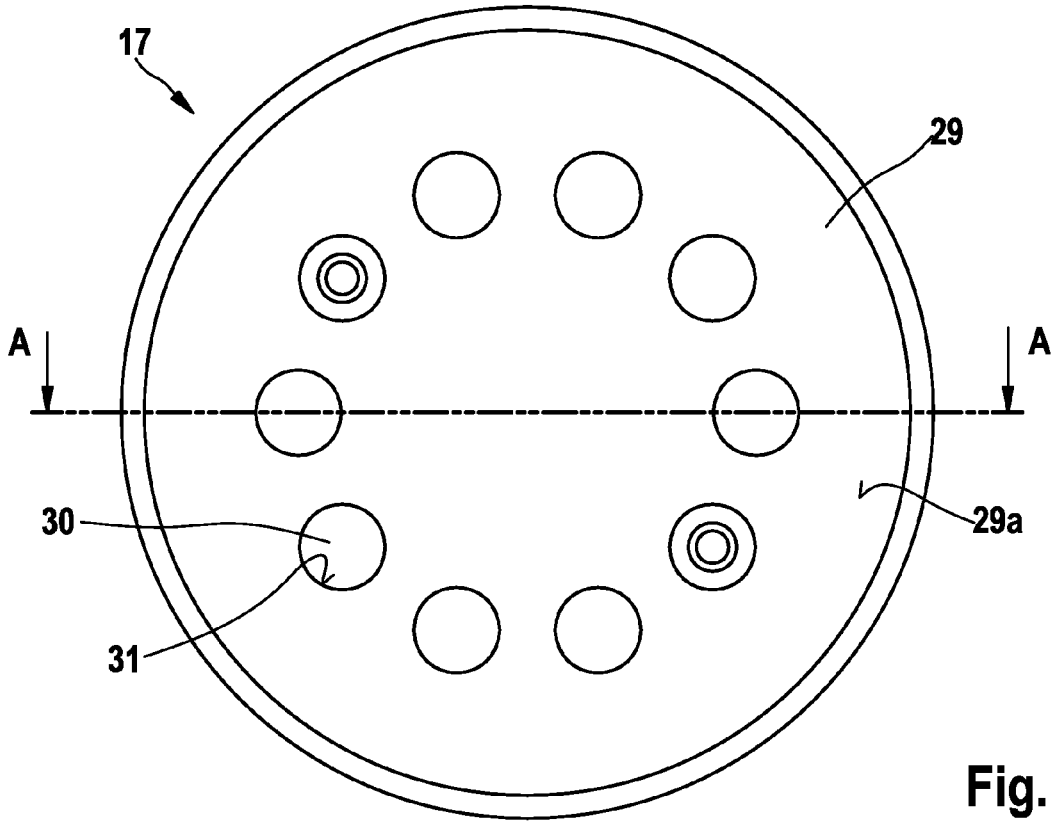
Figure 3:
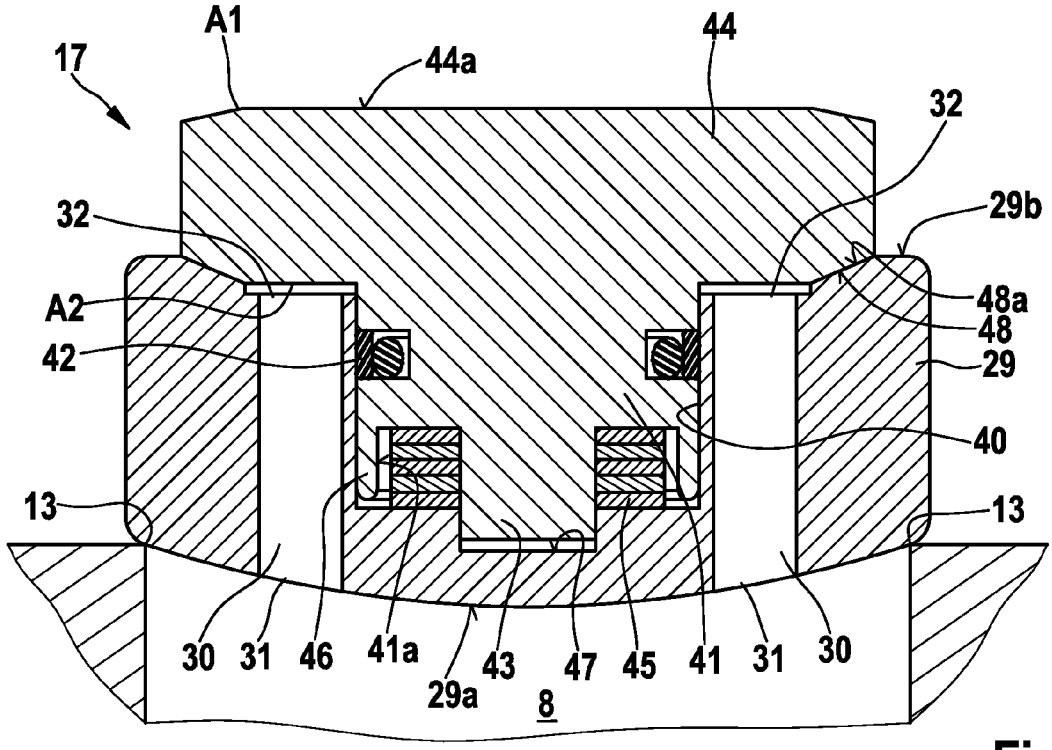
Figure 4:
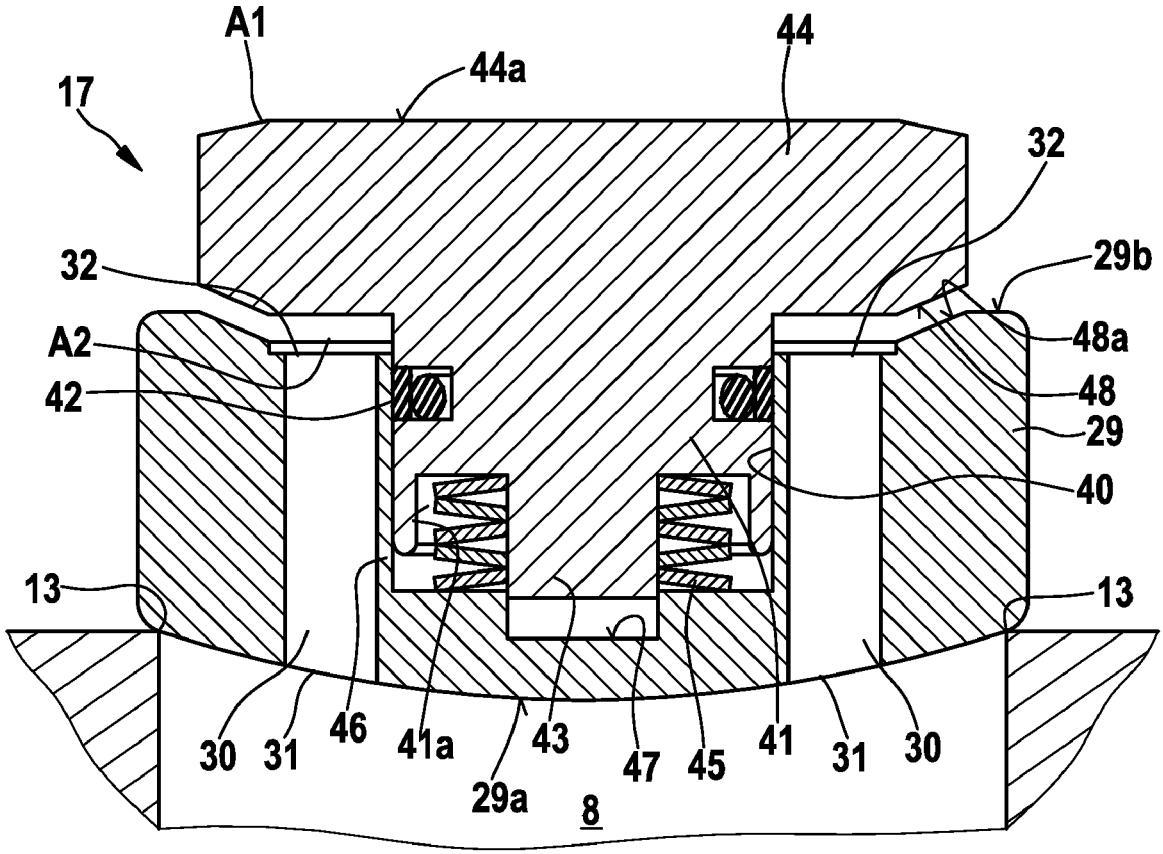
Figure 5:
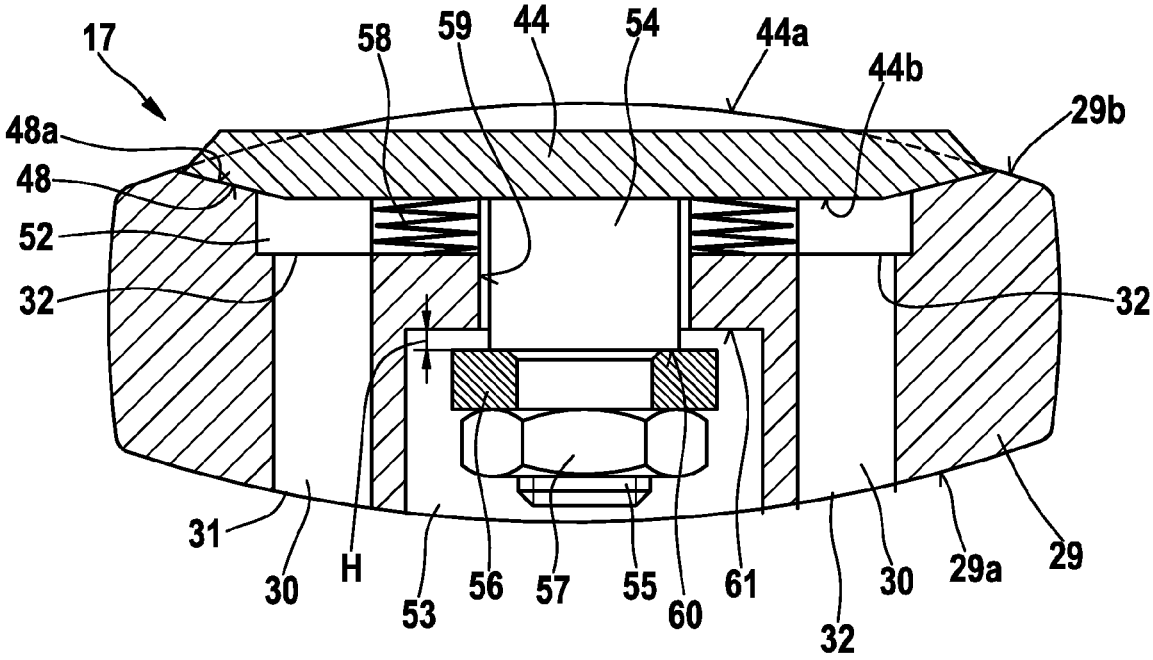
Figure 6:
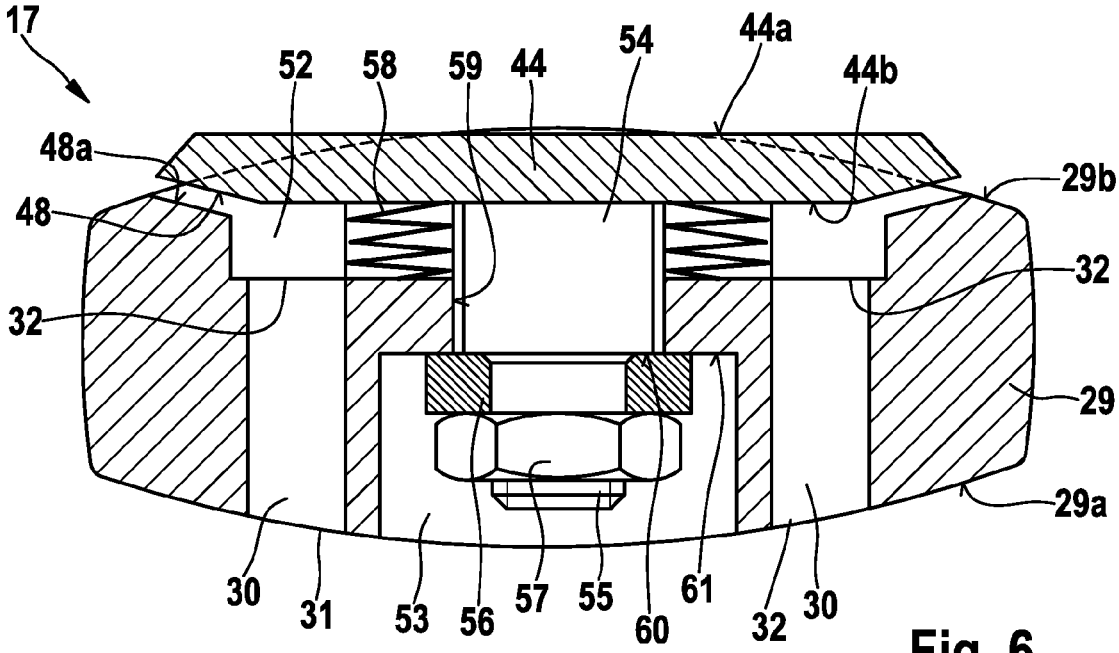
Figure 7:
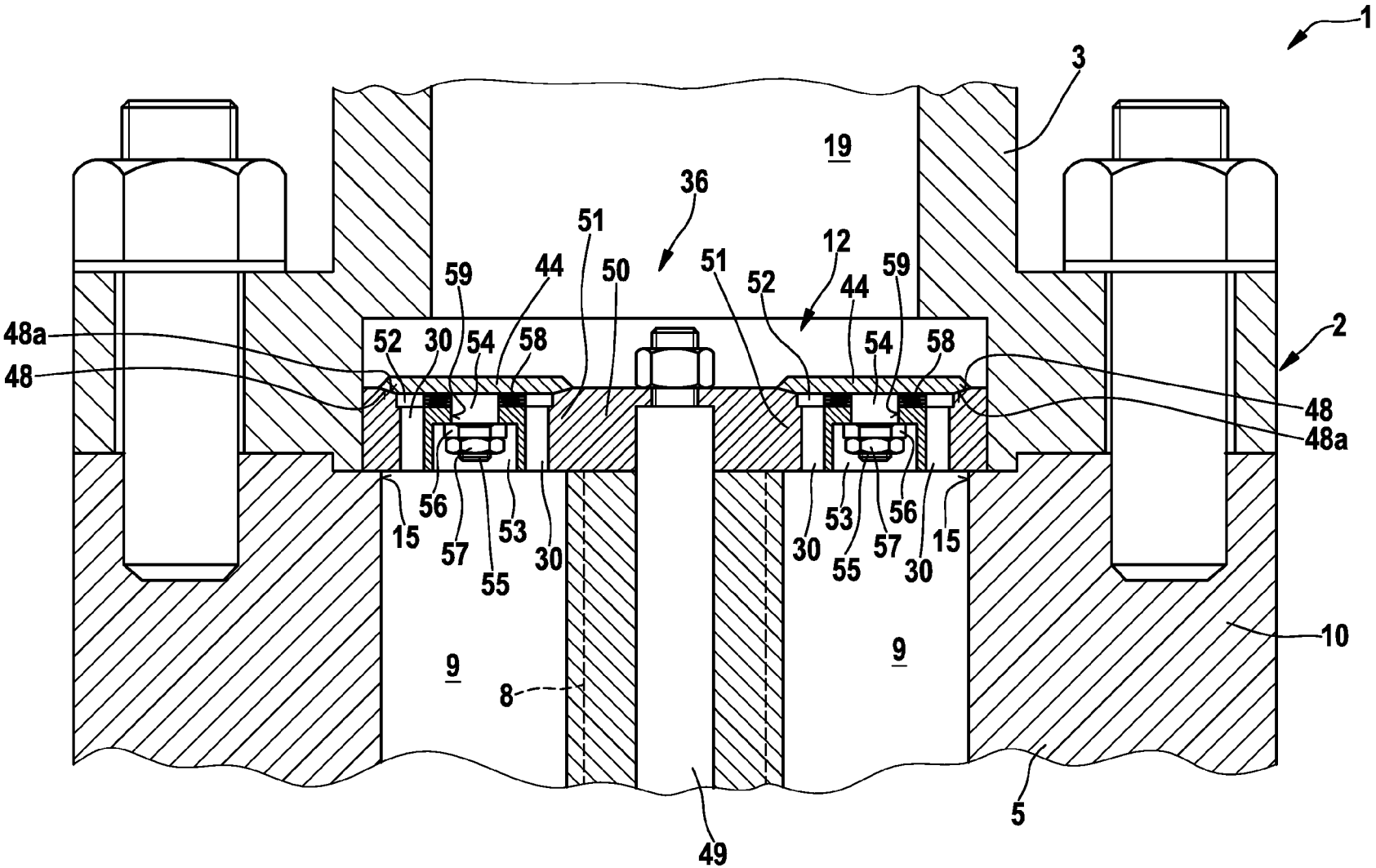

FIG. 2*a* is a view of the underside of a valve body shown in FIG. 1;

FIG. 3 is a sectional view of the valve body of FIG. 2*a* along section line A-A of FIG. 2*a* in a state of the tool at operating pressure;

FIG. 4 is a sectional view of the valve body as in FIG. 3, but in a condition after establishing pressure compensation between a channel opening and a flow-through channel of the tool at switching pressure;

FIGS. 5 and 6 are sectional views of a second embodiment of the valve body at operating pressure and at switching pressure; and FIG. 7 is a longitudinal sectional view of a second exemplary embodiment of a portion of a tool according to the present invention for cutting up coke, A tool 1 shown in FIGS. 1 and 2 for cutting up coke in a drum (not shown) comprises a housing 2 formed as a cast part, having fixed on its top portion 3, comprising cutting nozzles 4 (cf. FIG. 2), a bottom portion 5, comprising boring nozzles 6, as shown.

In housing 2 a hollow cylindrical inset 7 having an essentially cylindrical flow body 10 is arranged, through which flow channels 8, 9 extend (cf. also FIG. 2), having their top openings 13, 14 closable in pairs by two disk-shaped, calotte-shaped or dome-shaped valve bodies 17 of a valve means 12. The valve means 12 closes a flow channel 19, into which a supply channel 20 opens out, which is surrounded by a flange 21 at its top end.

In use, tool 1 is attached via flange 21 at the bottom end of a drill stem (not shown) through which water is guided in the operation of tool 1 under a high operating pressure of e.g. 300 bar and through tool 1. Within the latter, depending on each switching position of a control apparatus 28 connecting a switching apparatus 23 with the valve means 12, the water is passed either through the flow channels 8 and through an expansion 11 to boring nozzles 6, or via flow channels 9 to cutting nozzles 4, and used for boring or cutting the coke material.

Switching apparatus 23 extends from a housing cover 24 releasably mounted on top portion 3 of housing 2 by means of bolts and sealed with suitable means transverse to the longitudinal axis A of tool 1 in its radial direction up to the area of control apparatus 28.

A cylinder 34 and a spring 39, together with a piston 33, form a drive apparatus 26 of a switching element 27 for engagement with control apparatus 28 for rotating a distributing apparatus 36. The latter is supported on flow body 10 rotatable about an axis 37. It comprises cages 38 of valve means 12 for guiding lose valve bodies 17. In FIG. 1, the latter close openings 13, 14 of flow channels 8, while distributing apparatus 36 enables water to flow through corresponding passages (not shown) to flow channels 9 of cutting nozzles 4.

It can be seen from FIGS. 2*a*, 3 and 4 that valve body 17 is formed to be disk-shaped, calotte-shaped or dome-shaped and has a closure body 29 in its bottom area—with respect to its usage position—for closing off opening 13 of flow channel 8 with its underside 29*a*.

At least two channels 30, ten channels 30 in the present example, are arranged with spaces between them in closure body 29 and each extend from an opening 31 on the underside 29*a* of closure body 29 to another opening 32 on the top side 29*b* of closure body 29.

A blind hole bore 40 is formed as a cylinder in closure body 29 between channels 30, within which a piston 41 is coaxially displaceable and sealed by at least one seal 42. On the underside of piston 41 there is a recess 41*a* through which a central protrusion 43 extends from the underside of piston 41 to the bottom into a circular recess 47 in the center of closure body 29.

A spring 45 is arranged in annular recess 41*a* in the manner shown in the drawing and passed through protrusion 43. In FIG. 3 it is compressed by piston 41.

Piston 41 extends on the top side into a cap 44 extending beyond and around piston 41 and having a smaller diameter than closure body 29 in the present example. On the underside of cap 44, there is an annular sealing surface 48, which is pressed onto a corresponding annular sealing surface 48*a* on top surface 29*b* of closure body 29 in the position shown in FIG. 3 and therefore closes off openings 32 of channels 30.

Switching tool 1 from the cutting function to the boring function is carried out in the following manner:

First, the operating pressure $p_B$ in flow-through channel 19 is reduced to a switching pressure $p_S$. Then the pressure force of the water acting on piston 33 (FIG. 1) falls below the return force of spring 39, so that spring 39 presses piston 33 from an inactive position into an active position. Herein, piston 33 moves to the left as seen in FIG. 1, wherein control apparatus 28 is actuated by switching element 27 and therefore guiding apparatus 36 is rotated with valve means 12 until the desired switching of the operating mode of boring of tool 1 has been effected.

This switching operation, in which the two valve bodies 17 are each transferred by their cage 38 of valve means 12 along a 90° arc on the surface of flow body 10 until they reach the openings of flow channels 9, is now much more easily effected due to the initially described automatic pressure compensation effect of valve bodies 17, because switching pressure $p_S$ now acts both on top side 44*a* of cap 44 and its underside 29*a*. Due to this pressure compensation of valve body 17, only residual forces now act on cap 44, which are easily overcome. The automatic pressure equalization by valve bodies 17 will be explained in the following:

In the condition according to FIG. 3, the operating pressure $p_B$ is still present above valve body 17, and the ambient or normal pressure $p_O$ is present below valve body 17. Due to the high pressure differential $p_B-p_O$ valve body 17 closes opening 13 of flow channel 8 in flow body 10 at the annular seat of opening 13 with a very high force ensuring the necessary tightness of the closure.

For closing channels 30, cap 44 of valve body 17, with its sealing surface 48, is pressed against sealing surface 48*a* of closure body 29 with a force resulting from the pressure force due to the above mentioned pressure differential $p_B-p_O$ minus the spring force, so that openings 32 of channels 30 are closed. Piston 41 is arranged against the force of compressed spring 45 in the lower section of closure body 29 in blind hole bore 40, wherein protrusion 43 engages recess 47 for guiding purposes.

To switch tool 1 from cutting to boring, the operating pressure $p_B$ is reduced to the switching pressure $p_S$ in the order of $p_{Br}<15$ bar. This pressure reduction has the following effects on valve closure bodies 17:

- The cap force due to pressure $F_D=p_{Br}\times(A_1-A_2)$ resulting from the pressure, now $p_{Br}$, acting due to the surface difference $A_1-A_2$ of cap 44, is reduced and is now smaller than the force of compressed spring 45.
- As a result, piston 41 with cap 44 is pressed upwards by spring 45, so that the position shown in FIG. 4 results.
- Cap 44 has now exposed sealing surfaces 48, 48*a* and therefore openings 32 of channels 30. As a result, the space below valve body 17 is in communication with supply channel 20 (FIG. 1) via opening 13 of flow channel 8.
- This is how a pressure compensation in the space below valve body 17, namely in flow channel 8, where $p_O$ has been present recently, to switching pressure $p_S$, is effected via channels 30.
- The pressure compensation presupposes a sufficient number of channels 30 with a correspondingly large diameter of channels 30 and also a sufficient stroke of piston 41 in blind hole bore 40 and a sufficient force of spring 45, which is now relaxed. The dimensioning of channels 30 is to be done in such a way that switching pressure $p_S$ can be established in flow channel 8 immediately after lifting cap 44.
- The above pressure differential $p_B-p_O$ approaches zero due to the pressure compensation. As a result, valve body 17 will now no longer be pressed onto its seat in opening 13. This is why valve bodies 17 may now easily be released and displaced from their seats by cages 38. At the end of the switching operation, each valve body 17 has now reached the opening of each next flow channel 9.
- For initiating the boring process, the operation pressure $p_B$ in cutting tool 1 is increased again to $p_B>15$ bar.
- As a result, the cap force will be raised again due to pressure $F_D=p_B\times(A_1-A_2)$, now $p_B$, resulting from the pressure acting due to the surface difference $(A_1-A_2)$ of cap 44, and is now larger than the force of spring 45.
- As a result, piston 41 with cap 44 will now be pressed downwards against the force of spring 45, so that the position shown in FIG. 3 is reestablished.

The form of the second embodiment of valve body 17 according to FIGS. 5 and 6 in its basic configuration and in essential components corresponds to the first embodiment according to FIGS. 2*a*, 3 and 4, so that the differences of the alternative embodiment according to FIGS. 5 and 6 will be primarily described in the following.

Channels 30 extend at the top with their second openings 32 into a top recess 52 in the top section of closure body 29.

From underside 44*b* of cap 44, a cylindrical shank 54 extends through a guiding bore 59 in closure body 29 into a recess 53 within closure body 29. The end section of shank 54 comprises a threaded pin 55 onto which a stop ring 56 is screwed or set up to a shoulder 60 of shank 54 and secured with a lock nut 57 in this position. The distance between the top side of stop ring 56 and a shoulder 61 in recess 53 determines stroke H of cap 44 for opening the top openings 32 of channels 30, when switching pressure is established above cap 44 as shown in comparison with FIG. 6.

Between underside 44*b* of cap 44 and the bottom of top recess 52, a spring 58 extends about shank 54, as seen from the drawing.

The functioning of this valve body 17 essentially corresponds to that of valve body 17 in the first exemplary embodiment:

At a pressure which is higher than switching pressure, such as at operating pressure, cap 44 is sealingly pressed (sealing surfaces 48, 48*a*) onto closure body 29, so that spring 58 is compressed, as shown in FIG. 5

As soon as the pressure above valve body 17—when switching tool 1 to the boring or cutting function—is reduced to and falls below switching pressure, the force of spring 58 overcomes the water pressure exerted on cap 44 and lifts cap 44 up to the position shown in FIG. 6, where stop ring 56 abuts on stop 61 in recess 53 of closure body 29. Immediately after the other openings 32 of the channels in top recess 52 are opened, the desired pressure compensation is established between the space above valve body 17 and the flow channel, the upper opening of which is closed by valve body 17.

In the second embodiment of tool 1 according to FIG. 7, only the most essential components are mentioned of the basically known structure of tool 1, namely housing 2 with top portion 3 and bottom portion 5, and flow channels 8, 9 to the cutting and boring nozzles (not shown). Flow body 10 is incorporated here in bottom portion 5 of housing 2. Flow-through channel 19, in which valve means 12 serves as a distribution apparatus 36 for the water flow, is in communication with the supply channel (not shown). Valve means 12, unlike the previously described exemplary embodiment, comprises a valve disk 50 supported on flow body 10 and rotatable by means of a control rod 49.

Here, the valve bodies are sections 51 of valve disk 50 for closing off openings 15 of flow channels 9, as can be seen from the drawing.

Each of sections 51 acting as closure bodies, in the way seen from the drawing, has at least two, preferably about ten, channels 30 spaced with respect to each other, which extend from an opening open at the bottom in a continuous manner to the top in section 51, where their upper opening is sealingly closed off by cap 44.

In section 51 acting as a closure body, between channels 30, again, a bottom recess 53 and a guiding bore 49 are formed, within which shank 54 is coaxially displaceable. Below cap 44, there is a spring 58 in top recess 52.

For further details of the construction, explicit reference is made to the exemplary embodiments according to FIGS. 5 and 6, as far as there is a match according to the drawing.

For illustration of the mode of operation of these pressure compensation apparatus, closure body or section 51 is shown in the left part of FIG. 7 in the state which results at operating pressure in flow-through channel 19, while pressure compensation has been established in the right portion of FIG. 7.

For the rest, the manner of operation of this apparatus basically corresponds to that according to FIGS. 5 and 6. When the operating pressure is present in flow-through channel 19, channel 9 is closed (left channel 9 in FIG. 7). As soon as the operating pressure is reduced to switching pressure for switching tool 1 for example from boring to cutting, spring 58 overcomes the force resulting from the water pressure and acting on cap 44 so that cap 44 is lifted and opens upper openings of each channel 30 (right in FIG. 7). As a result, the pressure in flow channels 9 below section 51 is equalized to switching pressure as in flow-through channel 19, as explained in depth with reference to the description of the first exemplary embodiment.

Switching pressure now acts on the top surface and the bottom surface of valve disk 50 due to the pressure compensation, so that valve disk 50 may now easily be rotated by 90° with control rod 49 due to this pressure compensation, without strong forces associated with strong friction able to interfere with the switching of tool 1 from boring to cutting.

It should be explicitly noted that in each section 51 of valve disk 50, instead of the pressure compensation apparatus as shown in FIG. 7 and corresponding in structure to the exemplary embodiment according to FIGS. 5 and 6, an apparatus may also be integrated, corresponding in its structure to exemplary embodiment according to FIGS. 2*a*, 3 and 4.

The invention claimed is:

1. A tool for cutting up coke, comprising a housing mounted on a drill stem in the operating condition, and wherein at least one cutting nozzle for cutting and one boring nozzle for boring coke by means of a water jet, and a switchable valve arranged in a flow-through channel for alternatively feeding water to flow channels in a flow body for paths to the cutting and boring nozzles, and a switching apparatus manually or water-pressure-controlled operable at switching pressure of the water within the flow-through channel, for switching the switchable valve, are arranged, the switchable valve comprising a distribution apparatus rotatably supported above the flow body, with at least one valve body for closing off at least one opening of the flow channels, wherein depending on the angular position of the distribution apparatus with respect to the flow body, the flow path of the water to the boring nozzle or the flow path to the cutting nozzle is free or obstructed, wherein the valve body has means for compensating the pressure within the flow channel below the valve body to switching pressure as in the flow-through channel, the pressure compensating means comprising a closure body and a communication between the underside of the closure body facing the flow channel and an operating-pressure side of closure body exposed to the operating pressure of the water in operation for pressure compensation, and means for opening the communication for pressure compensation as soon as the operating pressure is reduced to switching pressure.

2. The tool according to claim 1, wherein the communication for pressure compensation comprises at least one channel having an opening which is open at the underside of the closure body, and having another opening at the operating-pressure side of the closure body which is associated with a closure, which closes the other opening at operating pressure and opens it at switching pressure for pressure compensation.

3. The tool according to claim 2, wherein the closure comprises a cap which closes off the other opening at operating pressure against the pressure of a spring and opens the other opening when, at switching pressure, the force of the spring is greater than the closing force of the water pressure acting on the cap.

4. The tool according to claim 3, wherein the closure comprises two annular sealing surfaces, one of which is arranged on the underside of the cap and the other is arranged on the top side of the closure body, and which work together to close and open the closure.

5. The tool according to claim 3 or 4, wherein the channel extends between the underside and the top side of the closure body.

6. The tool according to claim 3, wherein the closure comprises a top recess at the top side of the closure body below the cap, with which the channel is in communication via its other opening.

7. The tool according to claim 3, wherein a piston displaceable under spring pressure and sealed within a blind hole bore carries the cap in such association with the other opening of the channel that the cap is guided by the piston movement when it closes or opens the other opening of the channel.

8. The tool according to claim 3, wherein a shank displaceable under the pressure of a spring in a guiding bore of the closure body carries the cap in such association with the closure that the closure is closed at operating pressure and opened at switching pressure.

9. The tool according to claim 1, wherein the valve body is provided as a section of a valve disk rotatably supported on the flow body for pressure compensation between the space above the valve disk and the flow channels within the flow body.

* * * * *